US006159926A

United States Patent [19]

Crutzen et al.

[11] Patent Number: 6,159,926

[45] Date of Patent: Dec. 12, 2000

[54] BIODEGRADABLE FABRIC SOFTENING COMPOSITIONS BASED ON A COMBINATION OF PENTAERYTHRITOL ESTERS, BENTONITE AND POLYPHOSPHONATE COMPOUND

[75] Inventors: André Crutzen, Liège; France Wouters, Grace-Hollogne, both of Belgium

[73] Assignee: Colgate-Palmolive Co., New York, N.Y.

[21] Appl. No.: 09/360,053

[22] Filed: Jul. 23, 1999

Related U.S. Application Data

[63] Continuation-in-part of application No. 09/159,031, Sep. 23, 1998, abandoned.

[51] Int. Cl.[7] ..... C11D 1/83; C11D 3/36

[52] U.S. Cl. ..... 510/515

[58] Field of Search ..... 510/515

[56] References Cited

U.S. PATENT DOCUMENTS

| | | | |
|---|---|---|---|
| 4,912,056 | 3/1990 | Olson et al. | 435/263 |
| 5,126,060 | 6/1992 | Puentes-Bravo et al. | 252/8.6 |
| 5,290,459 | 3/1994 | Puentes-Bravo et al. | 252/8.6 |
| 5,332,513 | 7/1994 | Doms et al. | 252/8.6 |
| 5,332,527 | 7/1994 | Heinzman et al. | 252/546 |
| 5,358,647 | 10/1994 | Puentes-Bravo et al. | 252/8.6 |

*Primary Examiner*—John R. Hardee
*Attorney, Agent, or Firm*—Bernard Lieberman

[57] ABSTRACT

A biodegradable fabric softening composition or article is provided for softening laundry and is essentially free of a quaternary ammonium compound softener. The composition or article comprises a clay carrier, a defined polyphosphonate compound, and a defined PEC which is a fabric softening compound selected from among esters of pentaerythritol, oligomers of pentaerythritol or alkylene oxide derivatives of such esters and oligomers.

13 Claims, No Drawings

BIODEGRADABLE FABRIC SOFTENING COMPOSITIONS BASED ON A COMBINATION OF PENTAERYTHRITOL ESTERS, BENTONITE AND POLYPHOSPHONATE COMPOUND

This application is a continuation-in-part of copending U.S. Ser. No. 09/159,031 filed Sep. 23, 1998 now abandoned, the disclosure of which is incorporated herein by reference.

FIELD OF THE INVENTION

This invention relates to fabric softening compositions and/or articles for applications to washed laundry during rinsing and/or drying cycles, and to a method for preparing same. More particularly this invention relates to such compositions and articles that include as fabric softening components higher fatty acid esters of pentaerythritol, of pentaerythritol oligomers, or of ethoxylated derivatives thereof, all of which may be designated herein as PEC (for pentaerythritol compound) in combination with a clay carrier of the montmorillonite type, preferably, bentonite and a polyphosphonate compound as herein defined, and wherein such compositions and/or articles do not contain quaternary ammonium salts as fabric softener.

Fabric softening compositions and articles have long been employed to make washed laundry items softer to the touch and more comfortable to the wearer. Such compositions include solutions, emulsions, and particulate and powder products and such articles include paper strips that have been impregnated with fabric softener. The fabric softeners of choice for most commercial products have usually been quaternary ammonium salts, such as dimethyl ditallowyl ammonium chloride, and emulsions of such softener have been added to the rinse water in the washing machine to effectively soften laundry. Alternatively, such emulsions or powder products including such fabric softener can be added to the wash water, with a detergent composition, or the detergent composition can include a fabric softening component, to make a so-called "softergent". Articles that contain fabric softening component, such as a quaternary ammonium salt, may be added to the automatic laundry dryer, wherein during tumbling of the laundry in a heated environment, the fabric softener is applied to the laundry by repeated contact, and softens it.

Although various fabric softening (and antistatic) compositions have been commercially marketed over the years, with varying degrees of commercial success, and although various fabric softening components thereof have been included in them the most successful of such components have been the quaternary ammonium salts. Such compounds are of the formula

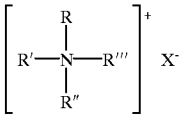

wherein R, R', R" and R'" are all alkyl groups, with at least one of such alkyls being a higher alkyl and with the others being lower alkyl(s) of 1 or 2 carbon atoms, and with $X^-$ being a salt-forming anion. Preferably, such quaternary ammonium salt is a di-lower alkyl, di-higher alkyl ammonium halide but mono-lower alkyl tri-higher alkyl ammonium halides have also found use in some instances.

While such quaternary ammonium salts have been effective fabric softeners in the described applications they are however characterized by certain disadvantageous properties, which have led to attempts to find replacements for them. For example, being cationic, they tend to react with anionic materials, sometimes to the detriment of their intended fabric softening function. Moreover, they are not as readily biodegradable as is desirable and they have been reported to be toxic to aquatic organisms, which could lead to harmful effects on aquatic life in lakes, rivers and other waters into which waste waters carrying such compounds could be emptied. Consequently, in many countries regulations have been promulgated restricting the use of quaternary ammonium compounds in products that are ultimately discharged into sewage and drainage systems.

In an effort to find replacements for quaternary ammonium salts as fabric softeners, the prior art has described fabric softening products based on pentaerythritol compounds, such as pentaerythritol esters used alone or in combination with a clay carrier. Such products are said to soften laundry without manifesting the environmental drawback associated with the use of quaternary ammonium compounds as softener, namely its alleged toxicity to aquatic organisms.

U.S. Pat. Nos. 5,126,060; 5,332,513; 5,358,647, and 5,290,459, all assigned to Colgate-Palmolive Company, describe various fabric softening products based on pentaerythritol esters, such products including agglomerated granules, aqueous emulsions and compositions and articles wherein such pentaerythritol esters are used alone or in combination with a clay carrier such as a sodium or calcium bentonite. While the aforementioned disclosures in the prior art have described the benefits of utilizing pentaerythritol esters as the primary fabric softening ingredient in a softening composition or article, there nevertheless remains a need to improve the overall softening performance of such compositions and articles in order to enhance their commercial appeal as effective alternatives to products based on quaternary ammonium salts.

SUMMARY OF THE INVENTION

In accordance with the present invention there is provided a biodegradable fabric softening composition or article for application to laundry so that a fabric softening portion thereof is deposited on the laundry and softens it, which fabric softening composition or article comprises:

(a) from about 75% to 99%, by weight, of a particulate clay carrier;

(b) from about 0.1% to about 25%, by weight, of a polyphosphonate compound characterized by containing at least two moieties having the structure $$—CH_2—PO(OX)_2$$

wherein X is Na or K, at least a portion of said polyphosphonate compound being electrostatically bound to the surface of said clay carrier; and (c) from about 1% to about 25%, by weight, of a PEC which is a fabric softening compound selected from the group consisting of a higher aliphatic $C_{12}$–$C_{22}$ ester of pentaerythritol, an oligomer of pentaerythritol, a $C_2$–$C_3$ alkylene oxide derivative of pentaerythritol or a $C_2$–$C_3$ alkylene oxide derivative of an oligomer of pentaerythritol, and mixtures thereof, at least a portion of said PEC being adsorbed on the surface of said clay carrier, whereby the interaction of said PEC with components (a) and (b) forms a fabric softening composition or article capable of providing a significantly enhanced softening benefit as compared to the softening benefit provided by an otherwise identical softening composition or article containing said PEC in combination with said clay carrier but in the absence of said polyphosphonate compound, and wherein said composition or article is essentially free of (i) a quaternary ammonium compound fabric softener; and (ii) a detergent builder other than the polyphosphonate compound of (b).

In accordance with the process of preparation aspect of the invention there is provided a process for preparing a biodegradable fabric softening composition comprising a particulate clay carrier in combination with a fabric softening amount of a pentaerythritol compound (PEC) and in the absence of a quaternary ammonium compound fabric softener comprising:

(a) heating said particulate clay carrier to a temperature of at least about 80° C.;

(b) contacting the heated clay particles of (a) with a polyphosphonate compound characterized by containing at least two moieties having the structure $—CH_2—PO(OX)_2$ wherein X is Na or K, such that at least a portion of said polyphosphonate compound is electrostatically bound to the clay particles;

(c) heating said PEC which is a compound selected from the group consisting of a higher aliphatic $C_{12}$–$C_{22}$ ester of pentaerythritol, an oligomer of pentaerythritol, a $C_2$–$C_3$ alkylene oxide derivative of pentaerythritol or a $C_2$–$C_3$ alkylene oxide derivative of an oligomer of pentaerythritol, and mixtures thereof, to a temperature above about its melting point; and then (d) contacting the molten PEC of (c) with the clay particles formed by step (b) such that at least a portion of said molten PEC is adsorbed on the surface of said clay particles to provide a fabric softening composition capable of providing an enhanced softening benefit.

Also, within the present invention is a process for softening fabrics during laundering comprising contacting such fabrics with an effective amount of a fabric softening composition or article during the washing, rinsing and/or drying operation wherein said fabric softening composition comprises:

(a) from about 75% to 99%, by weight, of a particulate clay carrier;

(b) from about 0.1% to about 25%, by weight, of a polyphosphonate compound characterized by containing at least two moieties having the structure $$—CH_2—PO(OX)_2$$

wherein X is Na or K, at least a portion of said polyphosphonate compound being electrostatically bound to the surface of said clay carrier; and (c) from about 1% to about 25%, by weight, of a PEC which is a fabric softening compound selected from the group consisting of a higher aliphatic $C_{12}$–$C_{22}$ ester of pentaerythritol, an oligomer of pentaerythritol, a $C_2$–$C_3$ alkylene oxide derivative of pentaerythritol or a $C_2$–$C_3$ alkylene oxide derivative of an oligomer of pentaerythritol, and mixtures thereof, at least a portion of said PEC being adsorbed on the surface of said clay carrier, whereby the interaction of said PEC with components (a) and (b) forms a fabric softening composition or article capable of providing a significantly enhanced softening benefit and wherein said composition or article is essentially free of (i) a quaternary ammonium compound fabric softener; and (ii) a detergent builder other than the polyphosphonate compound of (b).

The present invention is predicated on the discovery that the softening effects provided by the combination of a PEC compound and a clay carrier, such as bentonite, is materially enhanced when a polyphosphonate compound is contacted with the heated particulate clay carrier so as to be electrostatically bound thereto, thereby enhancing the substantivity of the molten PEC softener to the surface of the clay particles. In a preferred embodiment, the sequence of addition is such that polyphosphonate is contacted with the clay particles prior to contact of the clay with the PEC softener in order to significantly enhance the softening benefit capable of being delivered by the resultant softening composition or article. The polyphosphonate compound provides an initial treatment of the clay particles which renders the clay a more efficacious carrier for subsequent contact with the molten PEC softener.

DETAILED DESCRIPTION OF THE INVENTION

The pentaerythritol compound which may be abbreviated herein as PEC is one of the main fabric softening compounds in the invented compositions and articles of the present invention, apart from the fabric softening clay, such as bentonite which is also present. The PEC is preferably a higher fatty acid ester of pentaerythritol, a higher fatty acid ester of a pentaerythritol oligomer, a higher fatty acid ester of a lower alkylene oxide derivative of pentaerythritol or a higher fatty acid ester of lower alkylene oxide derivatives of pentaerythritol oligomers.

The oligomers of pentaerythritol are preferably those of two to five pentaerythritol moieties, more preferably 2 or 3, with such moieties being joined together through etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such grounds on a PEC, depending on the oligomer. At least one of the PEC OH groups and preferably at least two, e.g., 1 or 2 to 4 are esterified by a higher fatty acid or other higher aliphatic acid, which can be of an odd number of carbon atoms.

The higher fatty acid esters of the pentaerythritol compounds are preferably partial esters and more preferably there will be at least two free hydroxyls thereon after esterification (on the pentaerythritol, oligomer or alkoxyalkane groups). Frequently, the number of such free hydroxyls is two or about two but sometimes it may be one, as in pentaerythritol tristearate, or as many as eight, as in pentapentaerythritol tetrapalmitate.

The higher aliphatic or fatty acids that may be employed as esterifying acids are those of carbon atom contents in the range of 8 to 24, preferably 12 to 22 and more preferably 12 to 18, e.g., lauric, myristic, palmitic, oleic, stearic and behenic acids. Mixtures of such fatty acids, obtained from natural sources, such as tallow or coconut oil, or from such natural materials that have been hydrogenated may be used. Synthetic acids of odd or even numbers of carbon atoms may also be employed. Of the fatty acids, lauric or stearic acids are often preferred, and such preference may depend on the pentaerythritol compound being esterified.

Examples of some esters (PEC's) within the present invention follow:

Monopentaerythritol Esters

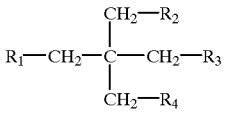

Monopentaerythritol Dilaurate $R_1$=$CH_3$—$(CH_2)_{10}$—COO—$R_2$=$CH_3$—$(CH_2)_{10}$—COO—

$R_3$=OH $R_4$=OH

Monopentaerythritol Monostearate $R_1$=$CH_3$—$(CH_2)_{16}$—COO—$R_2$=OH $R_3$=OH $R_4$=OH Monopentaerythritol Distearate $R_1$=$CH_3$—$(CH_2)_{16}$—COO—$R_2$=$CH_3$—$(CH_2)_{16}$—COO—

$R_3$=OH $R_4$=OH

Monopentaerythritol Tristearate $R_1$=$CH_3$—$(CH_2)_{16}$—COO—$R_2$=$CH_3$—$(CH_2)_{16}$—COO—

$R_3$=$CH_3$—$(CH_2)_{16}$—COO—$R_4$=OH

Monopentaerythritol Tetrastearate $R_1$=$CH_3$—$(CH_2)_{16}$—COO—$R_2$=$CH_3$—$(CH_2)_{16}$—COO—

$R_3$=$CH_3$—$(CH_2)_{16}$—COO—$R_4$=$CH_3$—$(CH_2)_{16}$—COO—

Monopentaerythritol Monopalmitate $R_1$=$CH_3$—$(CH_2)_{14}$—COO—$R_2$=OH $R_3$=OH $R_4$=OH Monopentaerythritol Dipalmitate $R_1$=$CH_3$—$(CH_2)_{14}$—COO—$R_2$=$CH_3$—$(CH_2)_{14}$—COO—

$R_3$=OH $R_4$=OH

Monopentaerythritol Tripalmitate $R_1$=$CH_3$—$(CH_2)_{14}$—COO—$R_2$=$CH_3$—$(CH_2)_{14}$—COO—

$R_3$=$CH_3$—$(CH_2)_{14}$—COO—$R_4$=OH

Monopentaerythritol Tetrapalmitate $R_1$=$CH_3$—$(CH_2)_{14}$—COO—$R_2$=$CH_3$—$(CH_2)_{14}$—COO—

$R_3$=$CH_3$—$(CH_2)_{14}$—COO—$R_4$=$CH_3$—$(CH_2)_{14}$—COO—

Monopentaerythritol Monobehenate $R_1$=$CH_3$—$(CH_2)_{20}$—COO—$R_2$=OH $R_3$=OH $R_4$=OH Monopentaerythritol Dibehenate $R_1$=$CH_3$—$(CH_2)_{20}$—COO—$R_2$=$CH_3$—$(CH_2)_{20}$—COO—

$R_3$=OH $R_4$=OH

Dipentaerythritol Esters

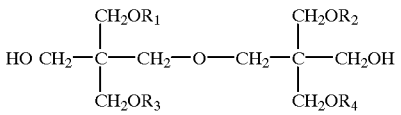

Dipentaerythritol Tetralaurate $R_1$=$CH_3$—$(CH_2)_{10}$—CO $R_2$=$CH_3$—$(CH_2)_{10}$—CO $R_3$=$CH_3$—$(CH_2)_{10}$—CO $R_4$=$CH_3$—$(CH_2)_{10}$—CO Dipentaerythritol Tetrastearate $R_1$=$CH_3$—$(CH_2)_{16}$—CO $R_2$=$CH_3$—$(CH_2)_{16}$—CO $R_3$=$CH_3$—$(CH_2)_{16}$—CO $R_4$=$CH_3$—$(CH_2)_{16}$—CO Pentaerythritol 10 Ethylene Oxide Ester

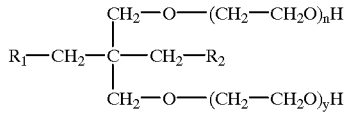

with n + y = 10

Monopentaerythritol 10 Ethylene Oxide Distearate $R_1$=$CH_3$—$(CH_2)_{16}$—COO—$R_2$=$CH_3$—$(CH_2)_{16}$—COO—

Although in the formulas given herein some preferred pentaerythritol compounds that are useful in the practice of this invention are illustrated it will be understood that various other such pentaerythritol compounds within the description thereof herein may be employed too, including such as pentaerythritol di-hydrogenated tallowate, pentaerythritol ditallowate, pentaeiythritol dipalmitate, and dipentaerythritol tetratallowate. Also, in this specification when reference is to a compound of a class, unless it is indicated otherwise it is to be considered that the employment of mixtures of compounds of such class are intended to be included (commercial compounds are often mixtures).

The clays that are useful components of the invented products are those which serve as an efficient carrier for the PEC's and thereby enable the PEC's to be dispersed in the wash bath, deposit onto the fabrics and provide softening or a surface lubricity to such fabrics. Such clays include the montmorillonite-containing or smectite clays. The best of the smectite clays for use in the present invention is bentonite and the best of the bentonites for purposes of serving as a carrier is calcium bentonite. Sodium bentonite which swells more than calcium bentonite in water has a better intrinsic softening efficacy but is nevertheless less preferred for purposes of the invention because it is a less efficient carrier for delivering the PEC to the fabric surface in the wash bath.

Other non-functional water insoluble carriers may also be utilized such as calcium carbonate and silica. The bentonites and similarly operative clays are of ultimate particle sizes in the micron range, e.g., 0.01 to 20 microns and of actual particle sizes in the range of No's. 100 to 400 sieves, preferably 140 to 325 sieves, U.S. Sieve Series. The bentonite and other suitable clays may be agglomerated to larger particle sizes too, such as 60 to 120 sieves.

Liquid state preparations of this invention may be emulsions (which term herein is also intended to refer to dispersions and suspensions in liquid media, as well as to emulsions), and any of such "emulsions" will normally be aqueous emulsions in which the aqueous phase is the continuous phase. However, solvents and cosolvents, such as ethanol, isopropanol, propylene glycol and various mono- and di-lower alkyl esters of diethylene glycol (Carbitols®) may also be present in such emulsions and microemulsions to promote formations of more stable products, and may also be in the continuous media. Suitable dispersing agents, such as emulsifiers, can be employed with the mentioned clay to further help it to disperse the PEC in aqueous media. Such are useful in liquid and solid (including particulate) products.

When the fabric softening compositions herein described are to be applied to laundry being dried in a laundry dryer, such as an automatic dryer, the PEC, polyphosphonate and clay carrier are preferably applied to a substrate material, from which it may be transferred to the drying laundry under the influence of the heat in the drying air and the rubbing action of the substrate against the moving laundry. The substrate used may be paper or other fibrous material, sponge, preferably cellulose or polyurethane, or other suitable base material.

The polyphosphonate compounds useful for the present invention are characterized by having at least two moieties having the structure $—CH_2—PO(OX)_2$ wherein X is sodium or potassium. A preferred compound is diethylene diamine pentaphosphonate. It is a commercially available material marketed by Monsanto as Dequest 2066, and has the following structure:

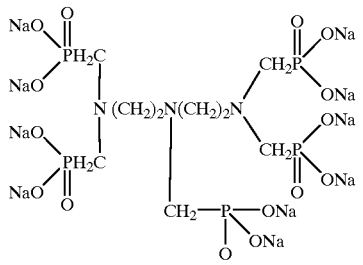

Other preferred compounds are Dequest 2016 and Dequest 2044 (Ethylene diamine tetraphosphonate).

The usual adjuvants that normally are present in other fabric softening compositions may be incorporated in the invented compositions and include perfumes, fixatives, solvents, cosolvents, hydrotropes, antioxidants, stabilizers, pH adjusters, buffers, biodegradable antimicrobials, builders, fillers, enzymes, thickeners and fluorescent brighteners, all of which are known classes of materials in the fabric softening compositions field, with examples of several of these being given in the art mentioned in this specification, such adjuvants being incorporated herein by reference.

The previous description of the components of the invented products is primarily directed to components of the fabric softening compositions for addition to wash or rinse waters. especially during automatic washing processes, which are simpler embodiments of the invention but the invention also includes detergent compositions (softergents) that contain the described fabric softening compositions. Such detergent compositions will contain at least one synthetic organic detergent, preferably of the anionic or nonionic type or a mixture thereof.

The anionic detergents are normally of the water soluble sulfate and/or sulfonate lipophile type, which may be designated "sulfonated", and which include lipophile and sulfonate moieties. Of the synthetic anionic organic sulfonated detergents those preferred are higher alkyl (preferably linear alkyl) benzene sulfonates, higher fatty alcohol sulfates, higher fatty alcohol ethoxylate sulfates, olefin sulfonates and paraffin sulfonates. Usually such compounds are water soluble alkali metal salts, such as sodium salts, and include higher fatty alkyl or other aliphatic moieties, which serve as lipophilic moieties, and which increase detergency, especially against greasy soils. Such higher alkyl or higher aliphatic moieties will normally be of 8 to 22 carbon atoms, preferably 10 or 12 to 16 or 18 carbon atoms and more preferably, especially for the alkyl sulfates and alkylbenzene sulfonates, the alkyl moieties will be of 12 to 14 carbon atoms. The higher fatty alcohol ethoxylate sulfates that are useful will normally be of 1 to 20 ethoxy groups per mole, preferably 3 to 10 or 15, e.g., 3 or 7. As representatives of anionic detergents there may be mentioned sodium linear dodecylbenzene sulfonate, sodium linear tridecylbenzene sulfonate, sodium lauryl alcohol sulfate, sodium coco alcohol triethoxylate sulfate, sodium $C_{16}$ paraffin sulfonate and sodium olefin sulfonate derived from $C_{14}$ olefin.

Among the nonionic detergents those which are most preferred are ethylene oxide condensates with higher fatty alcohols or with alkyl phenols, such as condensation products of 3 to 20, 5 to 15, 6 to 12 or 7 to 11 moles of ethylene oxide with higher fatty alcohols of 10 or 12 to 18 or 13 to 17 carbon atoms or with alkyl phenols of 7 to 10 carbon atoms in the alkyl groups, e.g., Dobanol® 25-7, Synperonic® A7, Neodol® 25-3, Neodol 25-7, Neodol 45-11, and $C_{13-7}$ alcohols condensed with 7 or 11 moles of ethylene oxide per mole.

In addition to the above examples of suitable anionic and nonionic detergents, extensive listings of such detergents that are useful may be found in standard textbooks relating to synthetic organic detergents, such as the McCutcheon texts, previously cited.

Of the water soluble builders for the anionic and nonionic detergents it is preferred to employ water soluble salts, such as sodium or potassium salts, more preferably sodium salts, and of these the carbonates, silicates, borates, bicarbonates and phosphates, especially the polyphosphates, are preferred, such as sodium carbonates, sodium bicarbonate, sodium silicate of $Na_2O:SiO_2$ ratio in the range of 1:1.6 to 1:3, preferably 1:2 to 1:3, e.g., about 1:3, 1:2.35 or 1:2.4, sodium tripolyphosphate and tetrasodium pyrophosphate, but sodium sesquicarbonate and sodium sesquisilicate may also be used, as may be the corresponding potassium and other soluble salts, when suitable. Of the water insoluble builders, which builders also have water softening properties, the most preferred are the zeolites, especially the hydrated zeolites. Such zeolites include crystalline, amorphous and mixed crystalline and amorphous zeolites of both synthetic and natural origins, which are sufficiently effective in counteracting calcium hardness ions in wash waters. Preferably, the zeolites employed are characterized as having high exchange capacities for calcium ions, which exchange capacity is normally from about 200 to 400 milligram equivalents of calcium carbonate per gram of the zeolite. Although other ion exchanging zeolites may also be utilized, often the zeolite will be of the formula $$(Na_2O)_x \cdot (Al_2O_3)_y \cdot (SiO_2) \cdot wH_2O$$

wherein x is 1, y is from 0.8 to 1.2, z is from 1.3 to 3.5 and w is from 0 to 9, and preferably is 2.5 to 6. Of the crystalline zeolites that are useful those preferred include Zeolites A, X and Y, with A being more preferable, and the most preferred of these is Zeolite 4A. These zeolites are preferably in finely divided state when added to the crutcher with the synthetic detergent prior to drying, and are of ultimate particle diameters and actual sizes like those previously described for the bentonites. Other builders that may be utilized include organic compounds, which are often sequestrants for hardness ions. Such compounds include organic acids, especially hydroxy and amino polycarboxylic acids, such as citric and gluconic acids and ethylene diamine tetraacetic acid (EDTA) and nitrilotriacetic acid (NTA), all usually as their water soluble salts, e.g., sodium salts. Additional useful builders are the organo-phosphorus chelating agents, such as the Dequest®, e.g, Dequest 2046, which are manufactured by Monsanto Co.

The proportions of components of the invented compositions and articles will be those which result in stable and effective products for fabric softening applications. For the polyphosphonate compound the concentration may vary from about 0.1% to about 25%, by weight, more preferably from about 0.5 to 10%, and most preferably from about 1 to 5%. For the PEC, an amount of from about 1% to about 25%, by weight, is generally effective for softening, more preferably from 2% to 20%, and most preferably from about 5 to 20%. The clay content varies from about 75 to about 99%, by weight, preferably from about 80% to 97%, by weight, and most preferably, from about 80% to 95%.

EXAMPLE 1

A fabric softening composition in accordance with the invention was prepared as follows using the raw materials described below:

1. Calcium bentonite (QPC 300) sold by Colin Stewart —U.K.
2. PEC, Pentaerythritol ditallowate sold by Hoechst —Germany (The pentaerythritol ditallowate is a (2:5:4:1) mixture of mono, di, tri and tetraester of hard tallow acid (28% palmitic acid and 66% stearic acid).
3. Polyphosphonate (Dequest 2066, 31% AI) sold by Monsanto
4. Tap water —300–400 ppm Ca $CO_3$ Two hundred grams of calcium bentonite were placed in a beaker inside a water bath maintained at 80° C. There was added to the beaker 17.7 g of Dequest 2066 in drop-wise fashion. slowly, while stirring the contents of the beaker with a stirrer propeller at about 1200 rpm. During this addition the mixture of bentonite and Dequest 2066 was sieved on a 1500 micron sieve to avoid the formation of aggregate particles. Following the addition of the Dequest 2066, the mixture was passed through the 1500 micron sieve once again.

About 50 grams of the PEC (an amount in excess of the required amount) were placed in a glass beaker in a microwave oven and melted. The melted PEC was maintained at 70°–75° C. Forty grams of the PEC were then added, drop-wise, slowly, to the above-described mixture of bentonite and Dequest 2066, while constantly stirring at about 1200 rpm. The dry blend was screened on a 1500 micron sieve during addition of the PEC, and once again, after all the PEC was added.

Granulation of the resulting powder was achieved by adding tap water (about 40 grams per batch) slowly, in drop-wise fashion, onto the dry powder blend which was maintained at 70°–75° C. to form spherical granular particles. The particles were then repeatedly sieved to remove oversize material, the resultant granules having a mean particle diameter of 500 microns with no more than about 1% of granules having a diameter above 1400 microns and no more than about 5% of granules having a diameter below 150 microns.

The granulated material was then placed in an oven at about 90° C. until the final moisture content of the material was reduced to within the range of 7–75% water. The color of the material was brownish-yellow and its density was about 1.0.

EXAMPLE 2

The purpose of this Example was to compare the softening performance of a granular detergent composition containing the fabric softening composition of the invention versus the softening performance of an otherwise identical detergent composition but containing a softening composition of the prior art, namely, a clay carrier containing a PEC softener as herein defined but in the absence of a polyphosphonate compound.

A commercial detergent composition "A" was used having a composition as shown below:

| COMPONENT | COMPOSITION A (Wt. %) |
|---|---|
| Anionic surfactant (linear alkyl benzene sulfonate) | 23.8% |
| Sodium tripolyphosphate | 19.5% |
| Silicate | 9.0% |
| Protease enzyme | 0.5% |
| Sodium hydroxide | 10.0% |
| Sodium sulfate | balance |

Granules of the softening composition of the invention were prepared as described in Example 1 and are referred to herein as softening granules "I".

For purposes of comparison, granules of a clay-PEC mixture in accordance with the prior art ("PA") were prepared following the preparation procedures of Example 1 except that Dequest 2066 (polyphosphonate) was omitted from the method of preparation. That is, the PEC was added to the bentonite powder as described in Example 1 but in the absence of polyphosphonate. The resulting granular composition is referred to herein as softening granules "PA".

To each of two samples of 174 grams of detergent composition "A" there was added 12.2 grams of softening granules I, and 12.2 grams of softening granules PA, respectively. Each of the two resulting products was added to a whirlpool U.S. washing machine at a concentration of 174 grams of product per wash. A ballast load of 2 kg of fabric was used per wash, at a wash temperature of 30° C. Washing tests were carried out in water of different hardness: a hardness of 50 ppm and 350 ppm, respectively, following which the fabrics were line-dried, and each towel was cut into 2 swatches.

In evaluating softness 6 judges were each asked to select the softest swatch in a 15 pair comparison of swatches washed with softening granules I and softening granules PA. The resulting selections are shown in Table 1.

TABLE 1

| | Number of Selections | |
|---|---|---|
| Product | Water Hardness (350 ppm) | 50 ppm |
| Composition A + 7% granules PA | 15 | 22 |
| Composition A + 7% granules I | 65 | 58 |
| No preference | 10 | 10 |

As noted from the Table, the softening composition of the invention provided a significantly superior softening performance relative to that provided by granules PA.

What is claimed is:

1. A biodegradable fabric softening composition or article for application to laundry so that a fabric softening portion thereof is deposited on the laundry and softens it, which fabric softening composition or article consists of:

(a) from about 75% to 99%, by weight, of a clay carrier;

(b) From about 0.1% to about 25%, by weight, of a polyphosphonate compound characterized by containing at least two moieties having the structure —$CH_2$—$PO(OX)_2$ wherein X is Na or K, at least a portion of said polyphosphonate compound being electrostatically bound to the surface of said clay carrier; and (c) from about 1% to about 25%, by weight, of a PEC which is a fabric softening compound selected from the group consisting of a higher aliphatic $C_{12}$–$C_{22}$ ester of pentaerythritol, an oligomer of pentaerythritol, a $C_2$–$C_3$ alkylene oxide derivative of pentaerythritol or a $C_2$–$C_3$ alkylene oxide derivative of an oligomer of pentacrythritol, and mixtures thereof, at least a portion of said PEC being adsorbed on the surface of said clay carrier, said polyphosphonate compound and said PEC being added sequentially to said clay carrier such that component (b) contacts said clay carrier prior to the addition of component (c), whereby the interaction of said PEC with components (a) and (b) forms a fabric softening composition capable of providing a significantly enhanced softning benefit as compared to the softening benefit provided by an otherwise identical softening composition or article containing said PEC in combination with the clay carrier but in the absence of said polyphosphonate compound.

2. A fabric softening composition or article according to claim 1 wherein the clay carrier is a montmorillonite clay.

3. A fabric softening composition or article according to claim 2 wherein the montmorillonite clay is a sodium, potassium, calcium or magnesium bentonite.

4. A fabric softening composition or article according to claim 1 wherein the PEC is a higher aliphatic ester of (i) pentaerythritol or (ii) an oligomer of pentaerythritol.

5. A fabric softening composition or article according to claim 1 wherein the polyphosphonate compound is diethylene diamine pentaphosphonate.

6. A process for preparing a biodegradable fabric softening composition consisting of a particulate clay carrier in combination with a fabric softening amount of a pentaerythritol compound (PEC) and in the absence of a quaternary ammonium compound fabric softener comprising:

(a) heating said particulate clay carrier to a temperature of at least about 80° C.;

(b) contacting the heated clay particles of (a) with a polyphosphonate compound characterized by containing at least two moieties having the structure —$CH_2$—$PO(OX)_2$ wherein X is Na or K, such that at least a portion of said polyphosphonate compound is electrostatically bound to the clay particles;

(c) heating said PEC which is a compound selected from the group consisting of a higher aliphatic $C_{12}$–$C_{22}$ ester of pentaerythritol, an oligomer of pentaerythritol, a $C_2$–$C_3$ alkylene oxide derivative of pentaerythritol or a $C_2$–$C_3$ alkylene oxide derivative of an oligomer of pentaerythritol, and mixtures thereof, to a temperature above about its melting point; and then (d) contacting the molten PEC of (c) with the clay particles formed by step (b) such that at least a portion of said molten PEC is adsorbed on the surface of said clay particles to provide a fabric softening composition capable of providing an enhanced softening benefit.

7. A process in accordance with claim 6 wherein the clay carrier is a sodium, potassium, calcium or magnesium bentonite.

8. A process in accordance with claim 6 wherein the PEC is a higher aliphatic ester of (i) pentaerythritol or (ii) an oligomer of pentaerythritol.

9. A process in accordance with claim 6 wherein the polyphosphonate compound is diethylene diamine pentaphosphonate.

10. A process of imparting softness to fabrics comprising contacting the fabrics with a softening effective amount of the fabric softening composition or article of claim 1.

11. A process in accordance with claim 10 wherein the clay carrier is a montmorillonite clay.

12. A process in accordance with claim 11 wherein the clay carrier is sodium, potassium, calcium or magnesium bentonite.

13. A process in accordance with claim 10 wherein the PEC is a higher aliphatic ester of (i) pentaerythritol or (ii) an oligomer of pentaerythritol.

* * * * *